United States Patent [19]

Pabodie

[11] 4,357,868

[45] Nov. 9, 1982

[54] PRINT WHEEL AND METHOD OF MAKING SAME

[75] Inventor: Robert M. Pabodie, Dayton, Ohio

[73] Assignee: Monarch Marking Systems, Inc., Dayton, Ohio

[21] Appl. No.: 233,792

[22] Filed: Feb. 12, 1981

[51] Int. Cl.[3] ..... B41J 1/22

[52] U.S. Cl. ..... 101/110; 101/415.1; 400/175

[58] Field of Search ..... 101/109, 110, 111, 415.1, 101/375, 376, 377, 378, 75, 106; 400/146, 174, 175

[56] References Cited

U.S. PATENT DOCUMENTS

| | | | |
|---|---|---|---|
| 2,919,641 | 1/1960 | Pfleger | 101/110 X |
| 2,961,951 | 11/1960 | Nitchie | 101/378 X |
| 3,824,928 | 7/1974 | Langer | 101/415.1 |
| 3,886,862 | 6/1975 | Hamisch, Jr. | 101/109 |
| 3,893,394 | 7/1975 | Fusco et al. | 101/378 X |
| 4,013,005 | 3/1977 | Keefe | 101/110 |
| 4,323,010 | 4/1982 | Hamisch, Jr. | 101/110 |

*Primary Examiner*—Edgar S. Burr
*Assistant Examiner*—Moshe I. Cohen
*Attorney, Agent, or Firm*—Joseph J. Grass

[57] ABSTRACT

There is disclosed a print wheel and a method of making a print wheel. The print wheel includes a generally annular base and a molded, unitary, flexible printing band having end portions. The printing band has a series of different printing elements disposed at spaced intervals along its length between the end portions. The printing band is disposed about the outer periphery of the base and the end portions of the band are inserted into spaced recesses in the outer periphery of the base. There is a printing element support between the end portions and one of the printing elements is disposed at a printing position on the support.

9 Claims, 4 Drawing Figures

PRINT WHEEL AND METHOD OF MAKING SAME

BACKGROUND OF THE INVENTION

1. Field of the Invention

The invention relates to the art of print wheels and to methods of making print wheels.

2. Brief Description of the Prior Art

U.S. Pat. No. 3,886,862 granted June 3, 1975 to Paul H. Hamisch, Jr. discloses a printing apparatus having a rotary driver in which end portions of a printing band are secured at spaced locations. U.S. Pat. No. 4,013,005 granted Mar. 22, 1977 to Jack D. Keefe discloses a print wheel having a base about which a printing band is wrapped, and end portions of the printing band are inserted in an undercut recess in the base which opens to the outer peripheries of the base.

U.S. patent application Ser. No. 95,854 filed Nov. 19, 1979 now U.S. Pat. No. 4,323,010, in the name of Paul H. Hamisch, Jr. discloses a print wheel including a generally annular base and a printing band disposed about the base and having end portions received and locked in spaced undercut recesses in the base.

SUMMARY OF THE INVENTION

The invention relates to a low-cost composite print wheel which includes a generally annular base and a molded, unitary, flexible printing band having end portions inserted into recess means at spaced locations. The printing band has a series of different printing elements disposed at spaced intervals along its length between the end portions. The base includes a printing element support between the end portions. The one printing element is disposed at a printing position on the support and the other printing elements are disposed at spaced printing positions. The recess means includes a pair of spaced undercut recesses. The end portions have locking members locked in the undercut recesses. Not only is the one printing element supported by the printing element support but the one printing element is resiliently held against the printing element support.

Also disclosed is a method of making a print wheel as described above. The method comprises the steps of molding a generally annular base, molding a unitary, flexible printing band having end portions, with the printing band having a series of different printing elements disposed at spaced intervals along its length between the end portions, the step of molding the base including the step of providing recess means open to the outer periphery of the base, positioning the printing band about the outer periphery of the base and inserting the end portions into the recess means at spaced locations, and supporting one of the printing elements at a printing position between the end portions.

DETAILED DESCRIPTION OF THE PREFERRED EMBODIMENTS

Figure 1:
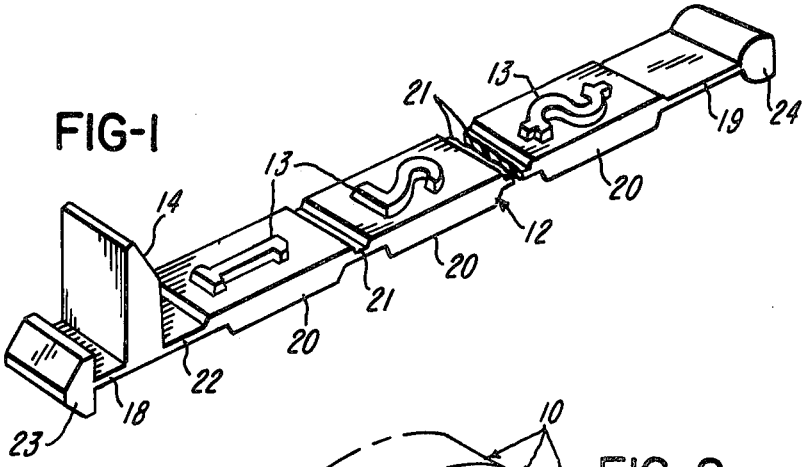
FIG. 1 is a fragmentary view of a printing band used in the print wheel of the invention.
Figure 2:
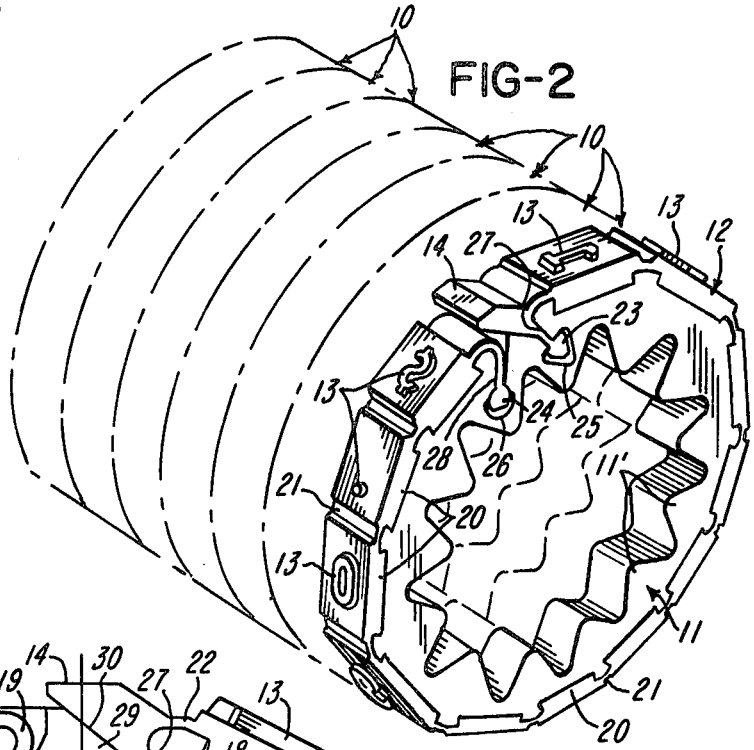
FIG. 2 is a fragmentary perspective view showing one print wheel in solid lines and like print wheels in phantom lines.
Figure 3:
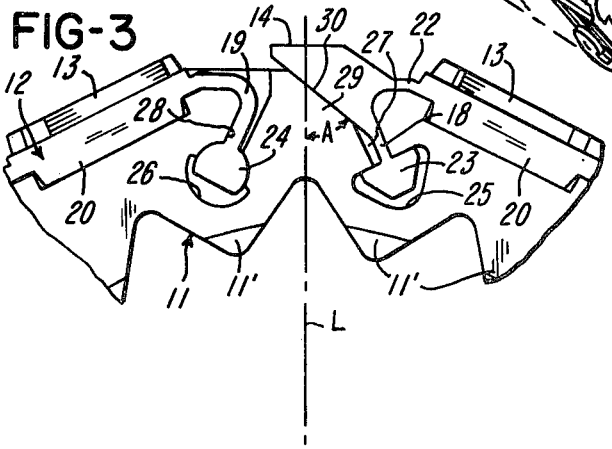
FIG. 3 is a fragmentary side elevational view of portions of the printing band and base of the print wheel.
Figure 4:
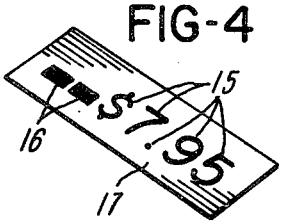
FIG. 4 is a perspective view of a tag or label printed by the type wheels of FIG. 2.

FIG. 2 shows a plurality of print wheels 10. Each print wheel 10 has a generally annular base 11 preferably molded in one piece of plastics material. The inner periphery of the base 11 has a series of equally spaced gear teeth 11' which can be used for detenting, or for driving the wheels 10, or both as in said Ser. No. 95,854. The print wheel 10 also includes a unitary molded, flexible printing band 12 molded preferably of elastomeric material. The unitary printing band 12 can be reinforced by cords or fabric if desired. The printing band 12 includes a series of spaced printing elements 13 and 14. The printing elements 13 typically print the desired numbers "1" through "9", "0", a decimal point and one or more monetary symbols. Each printing element 13 is shown to be adapted to print a number or symbol 15 and printing element 14 is shown to be adapted to print a rectangular mark or filler 16 on a tag or label 17 as shown in FIG. 4. The printing elements 13 and 14 are shown to be disposed between end portions 18 and 19. There is an integral lug 20 at the underside of each printing element 13. The printing elements 13 are connected by flexible hinges 21. A hinge 22 connects the printing element 14 and the adjacent printing element 13. The end portion 18 includes an integral locking member 23 and the end portion 19 includes an integral locking member 24. The base 11 includes a pair of spaced recesses 25 and 26 for receiving the respective locking members 23 and 24. The recesses 25 and 26 are shown to be located at least partly in adjacent internal teeth 11'. This enables the base 11 to have a small radial dimension. The recesses 25 and 26 open to the outer periphery of the base 11. The recesses have restricted portions 27 and 28. A printing element support 29 having a supporting or support surface 30 is disposed adjacent and between the recesses 25 and 26. The support surface 30 is made at an acute angle A with respect to a radial line L passing through the axis of the print wheel. By way of example, not limitation, the angle is about 26 degrees. The support 29 supports the printing element at a printing position. Each print element 13 and 14 is disposed at the outer periphery of the print wheel 10 at a different printing position. Although the printing element 14 is shown to have a rectangular face to print a rectangular character 16, the printing element 14 can be constructed to print any desired character. The entire printing band 12 is disposed on the base 11 under a slight amount of tension. The end portions 18 and 19 up to their respective locking members 23 and 24 are also under tension. The end portion 18 being under tension, the printing element 14, which is shown to be cantilevered, is drawn against the support surface 30 resiliently. As shown the printing band 12 is shown to undergo a sharp bend of about 116 degrees and thus the printing element 14 is pulled against the supporting surface. The recesses 25 and 26 are larger than the locking members 23 and 24 to facilitate insertion of the end portions 18 and 19.

In assembling the print wheel 10, the printing band 12 is placed about the outer periphery of the base 11 with the end portions 18 and 19 inserted through the one open ends of the recesses 25 and 26. As such the printing element 14 is supported on the support surface 30 of the support 29.

Other embodiments and modifications of this invention will suggest themselves to those skilled in the art, and all such of these as come within the spirit of this invention are included within its scope as best defined by the appended claims.

I claim:

1. Method of making a print wheel, comprising the steps of: molding a generally annular base having a generally annular surface, the base having two closely spaced recesses which open to the outer periphery of the base, molding a unitary, flexible printing band having opposite end portions, with the printing band having a series of different printing elements disposed at spaced intervals along its length between the end portions, the step of molding the base including forming a first support portion on the annular surface which extends between the recesses over substantially the entire periphery of the annular surface and forming a second support portion between the closely spaced recesses which extends over substantially the remainder of the periphery of the annular surface positioning the printing band about the outer periphery of the first support portion, inserting the end portions into the recesses, and supporting the printing element which is adjacent one of the end portions and projects beyond one of said recesses at a printing position on the second support portion.

2. Method of making a print wheel, comprising the steps of: molding a generally annular base having a generally annular surface, the base having two closely spaced recesses which open to the outer periphery of the base, molding a unitary, flexible printing band having opposite end portions, with the printing band having a series of different printing elements disposed at spaced intervals along its length between the end portions, the step of molding the base including forming a first support portion on the annular surface which extends between the recesses over substantially the entire periphery of the annular surface and forming a second support portion between the closely spaced recesses which extends over substantially the remainder of the periphery of the annular surface positioning the printing band about the outer periphery of the first support portion with the end portions being inserted in the recesses, supporting the printing element which is adjacent one of the end portions and projects beyond one of said recesses at a printing position on the second support portion, and wherein the positioning step includes bending the printing band about acute angles at each end portion.

3. A print wheel, comprising: a generally annular base having a generally annular surface, the base having two closely spaced recesses which open to the outer periphery of the base, the recesses defining a first support portion on the annular surface which extends between the recesses over substantially the entire periphery of the annular surface and a second support portion which extends between said recesses over substantially the remainder of the periphery of the annular surface, a molded, unitary, flexible printing band having opposite end portions, the printing band having a series of different printing elements disposed at spaced intervals along its length between the end portions, wherein the inner periphery of the base is defined by gear teeth and each recess extends into a respective tooth, the printing band being disposed about the first support portion and having its end portions projecting into and held in the recesses, the printing element adjacent one of the end portions projecting beyond one of said recesses and being supported at a printing position on the second support portion.

4. A print wheel as defined in claim 3, wherein the first and second portions are molded integrally.

5. A print wheel, comprising: a generally annular base having a generally annular surface, the base having two closely spaced recesses which open to the outer periphery of the base, the recesses defining a first support portion on the annular surface which extends between the recesses over substantially the entire periphery of the annular surface and a second support portion which extends between said recesses over substantially the remainder of the periphery of the annular surface, a molded, unitary, flexible printing band having opposite end portions, the printing band having a series of different printing elements disposed at spaced intervals along its length between the end portions, the printing band being disposed about the first support portion and having its end portions projecting into and held in the recesses, the printing element adjacent one of the end portions projecting beyond one of said recesses and being supported at a printing position on the second support portion.

6. A print wheel, comprising: a generally annular base having a generally annular surface, the base having two closely spaced recesses which open to the outer periphery of the base, the recesses defining a first support portion on the annular surface which extends between the recesses over substantially the entire periphery of the annular surface and a second support portion which extends between said recesses over substantially the remainder of the periphery of the annular surface, a molded, unitary, flexible printing band having opposite end portions, the printing band having a series of different printing elements disposed at spaced intervals along its length between the end portions, the printing band being disposed about the first support portion and having its opposite end portions projecting into and held in the recesses, the printing element adjacent one of the end portions being longer than the other printing elements and projecting beyond one of said recesses and being supported at a printing position on the second support portion.

7. A print wheel, comprising: a generally annular base having a generally annular surface, the base having two closely spaced recesses which open to the outer periphery of the base, the recesses defining a first support portion on the annular surface which extends between the recesses over substantially the entire periphery of the annular surface and a second support portion which extends between said recesses over substantially the remainder of the periphery of the annular surface, a molded, unitary, flexible printing band having opposite end portions, the printing band having a series of different printing elements disposed at spaced intervals along its length between the end portions, the printing band being disposed about the first support portion and having its end portions projecting into and held in the recesses, the printing element adjacent one of the end portions projecting beyond one of said recesses and being supported at a printing position on the second support portion, wherein the second support portion has a printing element supporting surface inclined at an acute angle with respect to a radial line passing through the axis of the print wheel.

8. A print wheel as defined in any one of claims 5, 7 or 6, wherein the first and second portions are molded integrally.

9. A print wheel as defined in claim 7, wherein the angle is about 26 degrees.

* * * * *